US008906171B2

(12) United States Patent
Magnusson et al.

(10) Patent No.: US 8,906,171 B2
(45) Date of Patent: Dec. 9, 2014

(54) TWIP AND NANO-TWINNED AUSTENITIC STAINLESS STEEL AND METHOD OF PRODUCING THE SAME

(71) Applicants: Ulrika Magnusson, Sandviken (SE); Guocai Chai, Sandviken (SE)

(72) Inventors: Ulrika Magnusson, Sandviken (SE); Guocai Chai, Sandviken (SE)

(73) Assignee: Sandvik Intellectual Property, Sandviken (SE)

( * ) Notice: Subject to any disclaimer, the term of this patent is extended or adjusted under 35 U.S.C. 154(b) by 0 days.

(21) Appl. No.: 14/347,711

(22) PCT Filed: Sep. 25, 2012

(86) PCT No.: PCT/EP2012/068815

§ 371 (c)(1),
(2), (4) Date: Mar. 27, 2014

(87) PCT Pub. No.: WO2013/045414

PCT Pub. Date: Apr. 4, 2013

(65) Prior Publication Data

US 2014/0328715 A1 Nov. 6, 2014

(30) Foreign Application Priority Data

Sep. 29, 2011 (EP) ..... 11183207

(51) Int. Cl.

| | |
|---|---|
| ***C22C 38/42*** | (2006.01) |
| ***C22C 38/44*** | (2006.01) |
| ***C21D 7/02*** | (2006.01) |
| ***B21C 1/00*** | (2006.01) |
| ***C22C 30/02*** | (2006.01) |
| ***C22C 38/58*** | (2006.01) |
| ***C22C 38/00*** | (2006.01) |
| ***C22C 38/02*** | (2006.01) |

(52) U.S. Cl.

CPC ..... *C22C 38/58* (2013.01); *C22C 38/42* (2013.01); *B21C 1/003* (2013.01); *C22C 30/02* (2013.01); *C22C 38/44* (2013.01); *C22C 38/001* (2013.01); *C22C 38/02* (2013.01)

USPC ..... 148/327; 148/419; 148/578; 148/610; 420/49; 420/52; 420/582; 420/584.1; 420/586.1

(58) Field of Classification Search

None

See application file for complete search history.

(56) References Cited

U.S. PATENT DOCUMENTS

| | | | | |
|---|---|---|---|---|
| 2,696,450 | A * | 12/1954 | Breeler | 148/578 |
| 3,615,921 | A * | 10/1971 | Delgrosso | 148/515 |
| 7,699,946 | B2 * | 4/2010 | Zhao et al. | 148/577 |
| 2009/0010793 | A1 * | 1/2009 | Becker et al. | 420/38 |
| 2009/0178739 | A1 * | 7/2009 | Ishida et al. | 148/608 |

FOREIGN PATENT DOCUMENTS

| | | | |
|---|---|---|---|
| EP | 0320820 | A1 | 6/1989 |
| EP | 1046723 | A1 | 10/2000 |

OTHER PUBLICATIONS

Zhang et al: Thermal stability of sputter-deposited 330 austenitic stainless-steel thin films with nanoscale growth twins:, Applied Physics Letters, AIP, American Institute of Physics, Melville, NY, US. vol. 87, No. 23, Dec. 2, 2005.

Liu, G.Z., Tao, N.R., Lu, K: "316L austenite stainless steels strengthened by means of nano-scale twins", Journal of Materials Science and Technology, vol. 26, No. 4. Apr. 1, 2010, pp. 289-292.

Ueno, H, et al: "Nanustructurization assisted by twinning during equal channel angular pressing of metastable 316L stainless steel", Journal Material Science, 2011. pp. 4276-4283.

* cited by examiner

*Primary Examiner* — Deborah Yee

(74) *Attorney, Agent, or Firm* — Corinne R. Gorski

(57) ABSTRACT

The invention relates to a method of producing a TWIP and nano twinned austenitic stainless steel. The austenitic steel should not contain more than 0.018 wt % C, 0.25-0.75 wt % Si, 1.5-2 wt % Mn, 17.80-19.60 wt % Cr, 24.00-25.25 wt % Ni, 3.75-4.85 wt % Mo, 1.26-2.78 wt % Cu, 0.04-0.15 wt % N, and the balance of Fe. In order to form nano twins in the material the austenitic stainless steel should be brought to a temperature below 0° C., and imparted a plastic deformation to such a degree that the desired nano twins are formed, e.g. to a plastic deformation of around 30%. The invention also relates to the thus produced austenitic stainless steel.

15 Claims, 13 Drawing Sheets

TWIP AND NANO-TWINNED AUSTENITIC STAINLESS STEEL AND METHOD OF PRODUCING THE SAME

RELATED APPLICATION DATA

This application is a §371 National Stage Application of PCT International Application No. PCT/EP2012/068815 filed Sep. 25, 2012 claiming priority of EP Application No. 11183207.7, filed Sep. 29, 2011.

TECHNICAL FIELD

The invention relates to an austenitic stainless steel material with twin induced plasticity (TWIP) and to a method of producing an austenitic stainless steel material containing nano twins.

BACKGROUND

Austenitic stainless steels form an important group of alloys. Austenitic stainless steels are widely used in many different applications because they have excellent corrosion resistance, ductility and good strength. The annealed austenitic stainless steels are relatively soft. Although there are various ways of strengthening austenitic stainless steels, such strengthening operations often lead to an unwanted reduction of the ductility.

Lately, the introduction of nano twins in metal materials has proven to be an effective way to obtain materials with high strength and high ductility. All materials are however not susceptible to such processing. Further, there is no general operation, by means of which nano twins may be induced into a material. Different methods have been shown to have effects on the inducement of nano twins in different materials. A twin may be defined as two separate crystals that share some of the same crystal lattice. For a nano twin the distance between the separate crystals is less than 1 000 nm.

In US 2006/0014039 a method of inducing nano twins in a metallic foil of stainless steel is disclosed. Stainless steel is sputter deposited to a substrate. The nano twinning is achieved by applying a negative bias to the substrate, which results in a bombardment of Argon ions from the surrounding protective atmosphere. This bombardment alters the intrinsic, growth residual stress of the coating such that controlled layers of twins are formed. The method described is thus only applicable on the production of coatings or foils, and not on integral pieces of metal.

EP 1 567 691 discloses a method of inducing nano twins in a cupper material by means of an electro deposition method. The method is however restricted to function on copper materials.

Another possible way of introducing nano twins into metal materials is to plastically deform the material. One example is given in the scientific article "316L austenite stainless steels strengthened by means of nano-scale twins", (Journal of Materials Science and Technology, 26, 4, 289-292, by Liu, G. Z., Tao, N. R., & Lu, K). In this article a method of inducing nano scale twinning by plastic deformation at high strain rates is described. The strength of the material is thus increased. On the other hand the plasticity (ductility) of the nano twinned material is very limited, with an elongation-to-failure of about 6%. To improve the plasticity, the plastic deformation needs to be followed by a thermal annealing in order to partially re-crystallize the deformed structure.

Even though there are successful examples of increasing the strength of austenitic stainless steels there is no general method of inducing nano twins that functions over the whole composition span of austenitic stainless steels. Further, no twin induced plasticity (TWIP) in austenitic steels has been reported. TWIP signifies that the formation of twins has occurred during plastic deformation and that as a result thereof an increase of both the strength and the ductility or elongation has been achieved.

SUMMARY

An object of the invention is to provide an austenitic stainless steel material with improved strength, and a method of producing the same. A further object is to provide an austenitic stainless steel material with improved ductility or elongation, and a still further object is to provide an austenitic stainless steel material with both improved strength and improved ductility or elongation, e.g. austenitic stainless steel with twin induced plasticity. These objects are achieved by the invention according to the independent claims.

According to a first aspect, the invention relates to a method of producing a nano twinned austenitic stainless steel, characterised by the steps of: providing an austenitic stainless steel that contains not more than 0.018 wt % C, 0.25-0.75 wt % Si, 1.5-2 wt % Mn, 17.80-19.60 wt % Cr, 24.00-25.25 wt % Ni, 3.75-4.85 wt % Mo, 1.26-2.78 wt % Cu, 0.04-0.15 wt % N, and the balance of Fe and unavoidable impurities; bringing the austenitic stainless steel to a temperature below 0° C., and imparting plastic deformation to the austenitic steel at that temperature to an extent that corresponds to a plastic deformation of at least 30% such that nano twins are formed in the material.

According to a second aspect, the invention relates to an austenitic stainless steel material that contains not more than 0.018 wt % C, 0.25-0.75 wt % Si, 1.5-2 wt % Mn, 17.80-19.60 wt % Cr, 24.00-25.25 wt % Ni, 3.75-4.85 wt % Mo, 1.26-2.78 wt % Cu, 0.04-0.15 wt % N, and the balance of Fe and unavoidable impurities; wherein the mean nano-scale spacing in the material is below 1000 nm and in that the nano twin density is above 35%.

Such an austenitic stainless steel material is formed by the inventive method, and such steel material has very good tensile properties and ductility, which are far better than for an austenitic stainless steel material of the same composition with no induced nano twins. This is true also for austenitic stainless steel material of the same composition that has been annealed or cold worked.

SHORT DESCRIPTION OF THE DRAWINGS

Below the invention will be described in detail with reference to the accompanying figures, of which:

FIG. 1 shows a logic flow diagram illustrating the method according to the invention;

FIG. 2*a* shows a comparison of the stress versus strain curves at for the austenitic stainless steel with TWIP according to the invention and a conventional austenitic stainless steel;

FIG. 2*b-c* shows comparisons of the stress versus strain curves at 4 different temperatures;

FIG. 2*d* shows an interpolation of the influence of the temperature at which drawing is accomplished on at what strain percentage nano twinning is commenced;

Figure 6A:
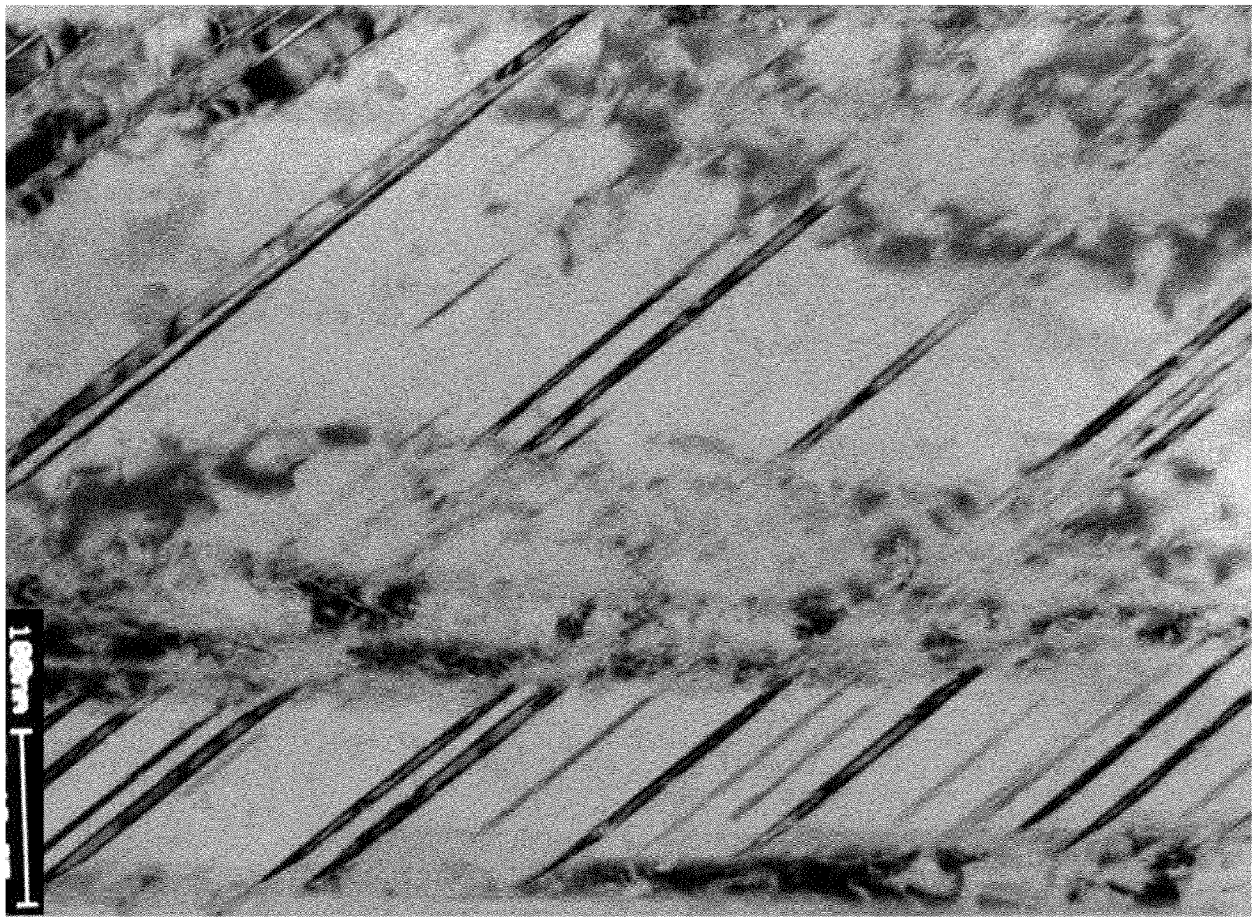
Figure 6B:
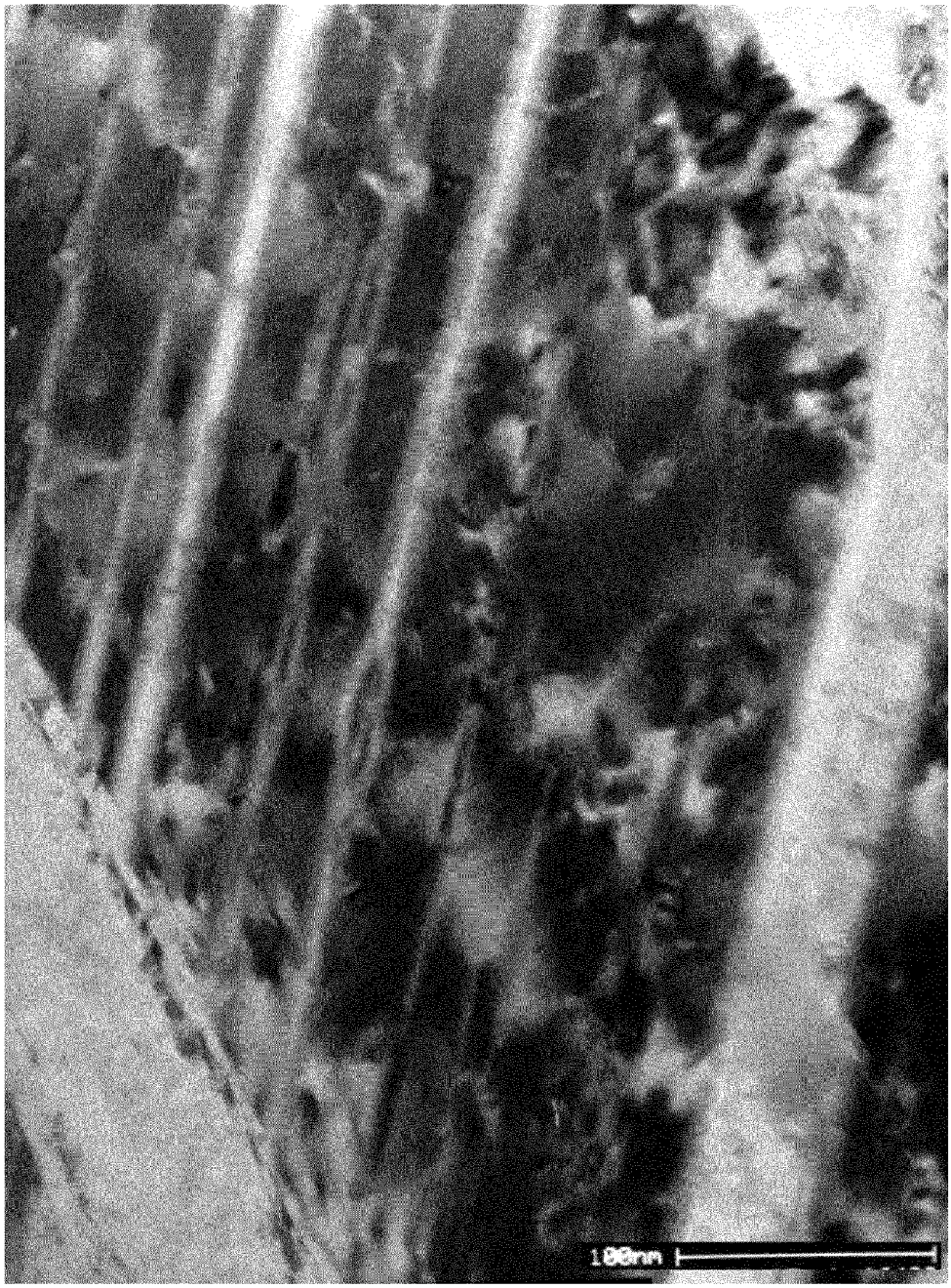
Figure 6C:
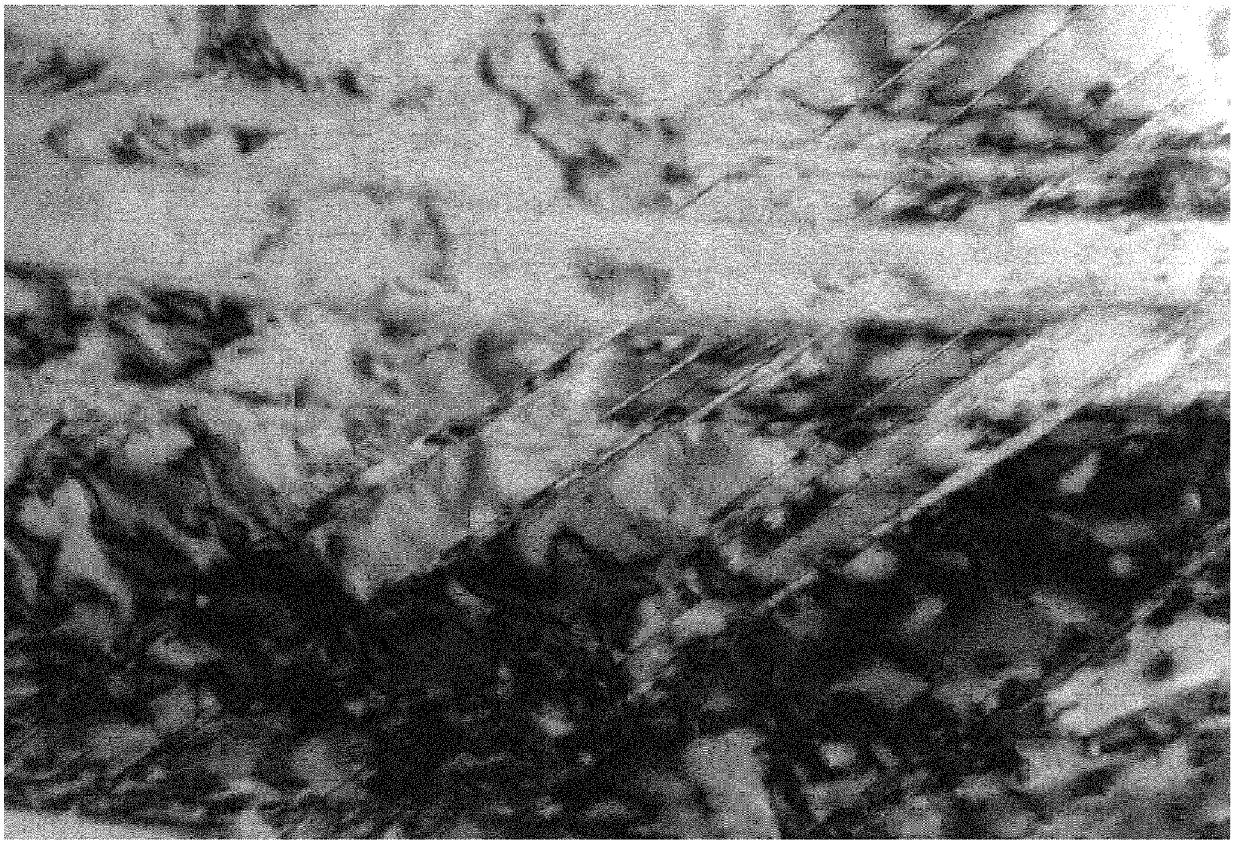
Figure 7:
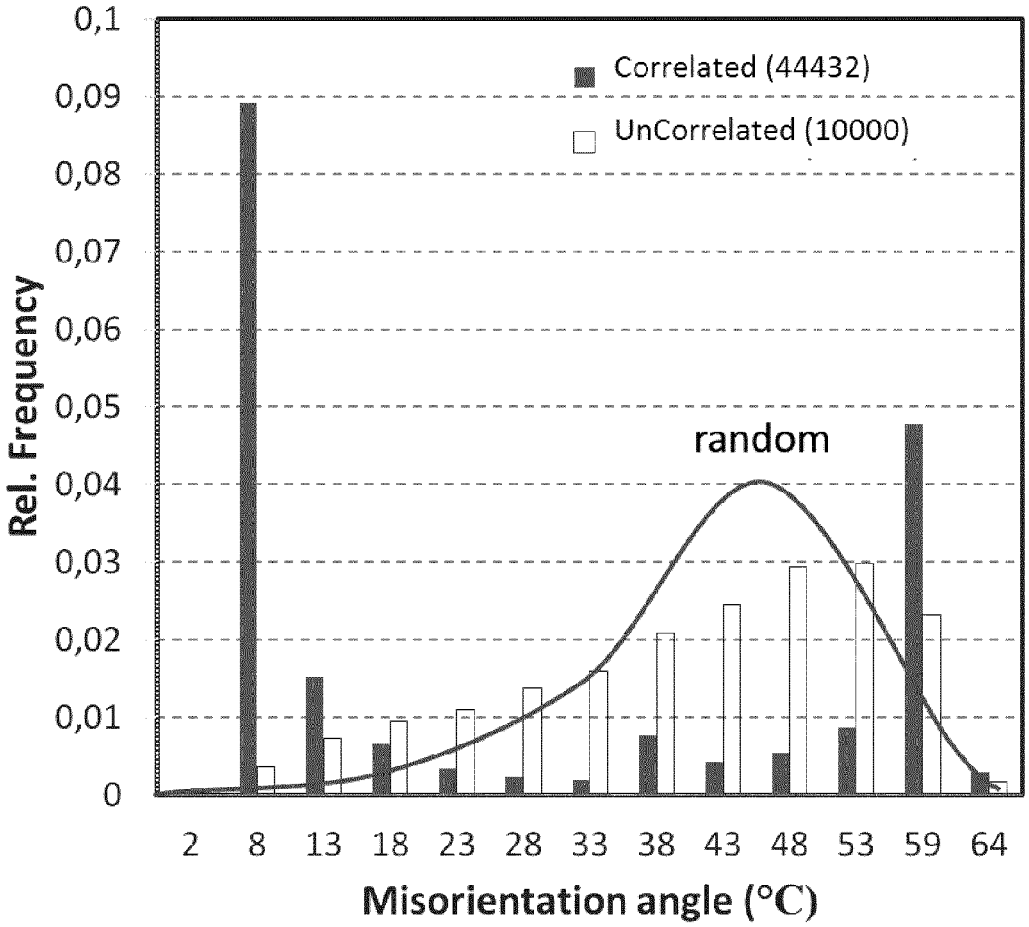
Figure 8:
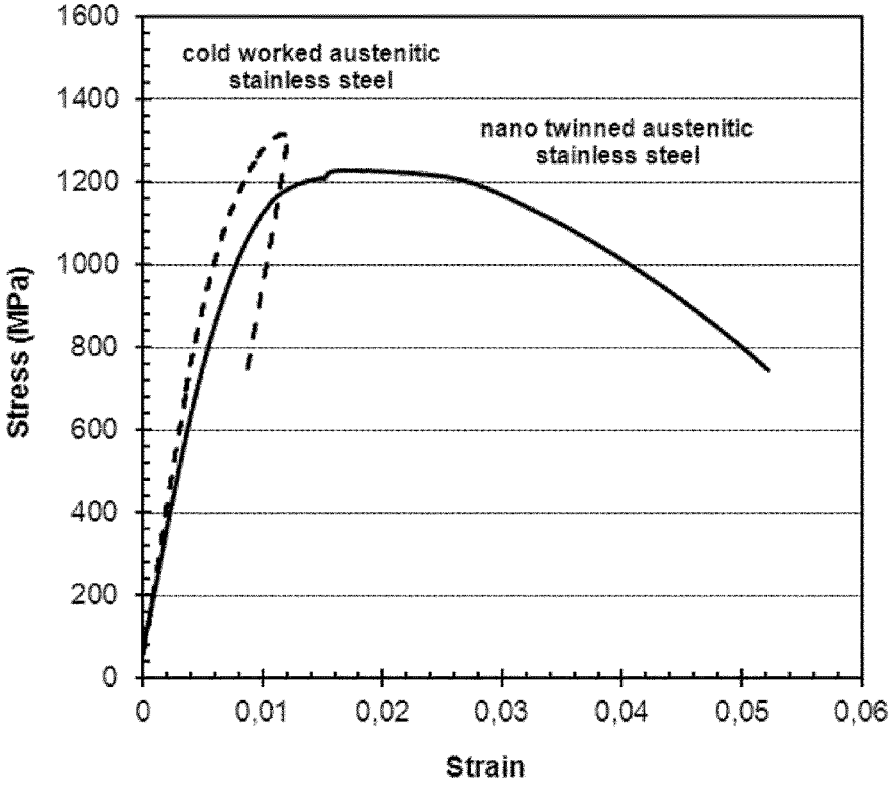

FIGS. 6*a-c* show the nano-twins in the austenitic stainless steel according to the invention in TEM investigations;

FIG. 7 shows the misorientations of the nano-twinned austenitic stainless steel according to the invention in an EBSD mapping;

FIG. 8 shows a comparison of stress versus strain curves of nano twinned austenitic stainless steel according to this invention and a conventional cold-worked high strength austenitic stainless steel.

Figure 9:
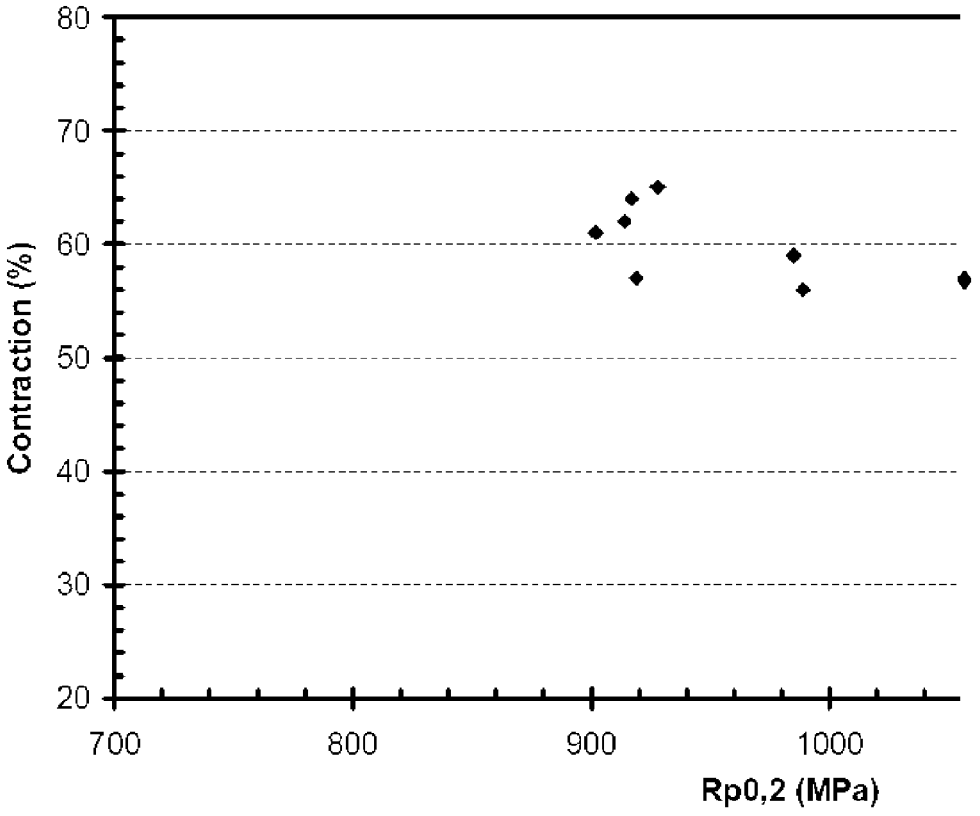

FIG. 9 shows the contraction of some inventive samples in correlation to the yield strength.

DETAILED DESCRIPTION

Austenitic stainless steels are widely used in various applications because of their excellent corrosion resistance in combination with a relatively high strength and ductility.

The invention is based on the notion that it is possible to further augment both the strength and ductility of austenitic stainless steels by the induction of nano twins by plastic deformation at low temperatures.

In austenitic stainless steels, care must be taken to conserve the austenitic structure of the material. The structure is dependent on both the composition of the steel and of how it is processed. The austenitic steel is a ferrous metal. Below, the general dependence of the different components of austenitic stainless steel is discussed. Further, the compositional ranges that delimit the austenitic steel according to the invention are specified.

Carbon is an austenite stabilizing element, but most austenitic stainless steels have low carbon contents, max 0.020-0.08%. The steel according the invention has an even lower carbon content level, i.e. lower than 0.018 wt %. This low carbon content further inhibits the formation of chromium carbides that otherwise results in an increased risk of intergranular corrosion attacks. Low carbon content may also improve the weldability.

Silicon is used as a deoxidising element in the melting of steel, but extra silicon contents are detrimental to weldability. The steel according to the invention has a Si-content of 0.25-0.75 wt %.

Manganese, like Si, is a deoxidising element. Further, it is effective to improve the hot workability. Mn is limited in order to control the ductility and toughness of the alloys at room temperature. The steel according to the invention has a Mn-content of 1.5-2 wt %.

Chromium is a ferrite stabilizing element. Also, by increasing the Cr content, the corrosion resistance increases. However, a higher Cr content may increase the risk of formation of the intermetallic phase such as sigma phase. The steel according to the invention has a Cr-content of 17.80-19.60 wt %.

Nickel is an austenite stabilizing element. A high nickel content may provide a stable austenitic microstructure, and may also promote the formation of the passive Cr-oxide film and suppress the formation of intermetallic phases like the sigma phase. The steel according to the invention has a Ni-content of 24.00-25.25 wt %.

Molybdenum is a ferrite stabilizing element. Addition of Mo greatly improves the general corrosion resistance of stainless steel. However, a high amount of Mo promotes the formation of sigma-phase. The steel according to the invention has a Mo-content of 3.75-4.85 wt %.

The addition of copper may improve both the strength and the resistance to corrosion in some environments, such as sulphuric acid. A high amount of Cu may lead to a decrease of ductility and toughness. The steel according to the invention has a Cu-content of 1.26-2.78 wt %.

Nitrogen is a strong austenite stabilizing element. The addition of nitrogen may improve the strength and corrosion resistance of austenitic steels as well as the weldability. N reduces the tendency for formation of sigma-phase. The steel according to the invention has a N-content of 0.04-0.15 wt %.

A challenge in the elaboration of an austenitic composition is to elaborate a composition that on the one hand does not form martensite during plastic deformation, and on the other hand is not prone to the formation of stacking faults. For example a high content of Nickel will suppress the formation of Martensite. On the other hand, a high content of Nickel will increase the risk of the formation of stacking faults during plastic deformation and thereby also suppress the formation of nano twins.

The intervals given above have proven to represent a good compromise inside which ranges a TWIP austenitic stainless steel may be provided by means of the method described below.

Example Samples

Below the invention will be described based on the observations of four samples having the composition within the ranges specified above and having been treated in accordance with the inventive method as described below.

The idea of the invention is that nano twins may be induced into samples of austenitic steel by plastically deforming the samples at a reduced temperature. This leads to a twin induced plasticity, TWIP.

Below, the characteristics of four specific samples of the material according to the invention are presented. The specific composition for each sample is presented in table 1 below.

TABLE 1

Specific composition of the samples.

| Materials | C | Si | Mn | P | S | Cr | Ni | Mo | Co | Cu | N | B |
|---|---|---|---|---|---|---|---|---|---|---|---|---|
| Sample 1 | 0.012 | 0.49 | 1.81 | 0.005 | 0.012 | 19.09 | 24.25 | 4.18 | <0.010 | 1.5 | 0.082 | 4 ppm |
| Sample 2 | 0.011 | 0.51 | 1.85 | 0.005 | 0.013 | 19.17 | 24.34 | 4.18 | <0.010 | 1.5 | 0.085 | 4 ppm |
| Sample 3 | 0.010 | 0.50 | 1.84 | 0.005 | 0.013 | 18.12 | 24.30 | 4.17 | <0.010 | 1.5 | 0.085 | 4 ppm |
| Sample 4 | 0.009 | 0.52 | 1.84 | 0.004 | 0.014 | 19.25 | 24.37 | 4.19 | <0.010 | 1.5 | 0.077 | 4 ppm |

As is visible from table 1, all samples comprise small amounts of phosphorus (P), sulphur (S), cobalt (Co), and boron (B). These elements are however part of the unavoidable impurities and should be kept as low as possible. They are therefore not explicitly included in the inventive composition.

The 4 samples were subjected to a drawing test at a reduced temperature in order to increase the strength by inducing nano twins in the material. All test samples had an initial length of 50 mm.

In the examples below, samples 1-4 were exposed to stepwise drawing. The stepwise or intermittent drawing implies that the stress is momentarily lowered to below 90%, or preferably to below 80% or 70% of the momentarily stress for a short period of time, e.g. 5 to 10 seconds, before the drawing is resumed. Further in order to avoid a temperature increase during the drawing, the material was continuously cooled by liquid nitrogen throughout the whole drawing process.

The intermittent plastic deformation has proven to be an effective way of increasing the total tolerance to deformation, such that a higher total deformation may be achieved than for a continuous deformation.

Sample 1

In the drawing test performed on sample 1, the sample was plastically deformed by tension at a rate of 30 mm/min, which corresponds to 1% per second. The sample was deformed to an extent of 3% per step to a total deformation of 50%. The drawing was performed at −196° C.

Sample 2

Sample 2 was plastically deformed by means of tension at a rate of 20 mm/min, which corresponds to 0.67% per second. The sample was deformed to an extent of 3% per step to a total deformation of 50%. The drawing was performed at −196° C.

Sample 3

Sample 3 was plastically deformed by means of tension at a rate of 30 mm/min, which corresponds to 1% per second. The sample was deformed to an extent of 3% per step to a total deformation of 65%. The drawing was performed at −196° C.

Sample 4

Sample 4 was plastically deformed by means of tension at a rate of 20 mm/min, which corresponds to 0.67% per second. The sample was deformed to an extent of 3% per step to a total deformation of 65%. The drawing was performed at −196° C.

Mechanical Properties of the Inventive Austenitic Steel Samples

Table 2 shows some typical tensile properties of the four specific nano twinned austenitic stainless steel samples according to the invention in a comparison with that of two reference austenitic steels. In the table Rp0.2 corresponds to the 0.2% proof strength or yield strength, Rm corresponds to the tensile strength, A corresponds to the elongation (ultimate strain), Z corresponds to the contraction, and E corresponds to Young's modulus. The first reference steel, SS1, is an annealed austenitic stainless steel, and the second reference steel, SS2, is a cold worked austenitic stainless steel.

TABLE 2

Comparison of mechanical properties of four inventive steels and two reference austenitic stainless steels.

| | Rp0.2 (MPa) | Rm (MPa) | A (%) | Z (%) | E (GPa) |
|---|---|---|---|---|---|
| Sample 1 | 930 | 1051 | 19.3 | 65 | 148 |
| Sample 2 | 1086 | 1097 | 13.6 | 55 | 148 |
| Sample 3 | 1091 | 1224 | 14.1 | 60 | 138 |
| Sample 4 | 1111 | 1211 | 12.6 | 53 | 153 |

TABLE 2-continued

Comparison of mechanical properties of four inventive steels and two reference austenitic stainless steels.

| | Rp0.2 (MPa) | Rm (MPa) | A (%) | Z (%) | E (GPa) |
|---|---|---|---|---|---|
| SS1 | 267 | 595 | 55 | | 195 |
| SS2 | 1122 | 1351 | 4.9 | | 151 |

The nano twinned austenitic stainless steel samples 1-4 according to the invention shows extremely high strength, high contraction and a reasonably good ductility. The highest yield strength obtained is 1111 MPa, which is about 300% higher than that of the annealed austenitic stainless steel. The modulus of elasticity of the nano twinned austenitic stainless steel (138-153 GPa) is much lower than that of the annealed austenitic stainless steel (195 GPa). It is only about 75% of the value for annealed material. This presents an advantage in some applications, such as e.g. in the field of implants, where a too high modulus of elasticity is not desired, and where strain controlled fatigue is important such as wireline.

Samples 1-4 have been treated under more or less optimal conditions. In other words, the temperature for test samples 1-4 was well below 0° C., i.e. −196° C. Further, a plastic deformation of at least 50% was imparted to the samples.

TABLE 3

Comparison of the influence of straining rate at −196° C., step interval and total strain on the tensile properties.

| Straining rate mm/min | Straining step % | Total strain % | Rp0.2 (MPa) | Rm (MPa) | A % | E (MPa) |
|---|---|---|---|---|---|---|
| 5 | 3 | 55 | 902 | 1095 | 14.6 | 167 |
| 5 | 3 | 55 | 914 | 1066 | 14.6 | 147 |
| 5 | 3 | 65 | 1057 | 1228 | 10.8 | 150 |
| 5 | 3 | 65 | 989 | 1237 | 9.94 | 165 |
| 10 | 3 | 33 | 804 | 916 | 24.9 | 148 |
| 10 | 3 | 30 | 863 | 985 | 21.1 | 157 |
| 20 | 3 | 17 | 771 | 876 | 27.2 | 145 |
| 20 | 3 | 50 | 921 | 1047 | 18.1 | 148 |
| 20 | 6 | 50 | 909 | 1036 | 14.2 | 148 |
| 20 | 3 | 65 | 1091 | 1224 | 14.1 | 138 |
| 20 | 3 | 65 | 1111 | 1211 | 12.6 | 153 |
| 30 | 3 | 50 | 930 | 1051 | 19.3 | 148 |
| 30 | 6 | 55 | 1086 | 1097 | 13.6 | 148 |
| 30 | 6 | 55 | 917 | 1089 | 18.2 | 161 |
| 40 | 3 | 55 | 919 | 1089 | 18.1 | 164 |
| 60 | 3 | 55 | 985 | 1081 | 16.3 | 149 |
| 60 | 3 | 55 | 928 | 1086 | 17.6 | 160 |

In table 3 the influence of straining rate, step interval and total strain on the tensile properties is shown. All straining tests in table 3 have been performed at −196° C.

As is apparent from tables 2 and 3 the total straining is the most important parameter for the achievement of nano twinned steel with high 0.2% proof strength or yield strength (Rp0.2) and high tensile strength (Rm). For all samples with a total straining of at least 50% the yield strength at a plastic deformation of 0.2% is above 900 MPa, and the tensile strength is above 1000 MPa. Further, for the four samples with a total straining of 65% the yield strength at a plastic deformation of 0.2% is above 1000 MPa for three out of four samples, and the tensile strength is above 1200 MPa for all four test samples.

It may also be noted that a lower effect appears at a total straining of 30% and that a further lower effect appears at a total straining of 17%. The effect achieved at a total straining of 30% is however good in that the yield strength at a plastic deformation of 0.2% is above 800 MPa, and the tensile strength is above 900 MPa for both these test samples. Hence, a total straining of 30% seems to be sufficient in order to achieve a relevant improvement of the tensile properties in an austenitic stainless steel of the inventive composition.

With respect to the other parameters, such as straining rate and straining step, no marked differences may be noted.

Figure 1:
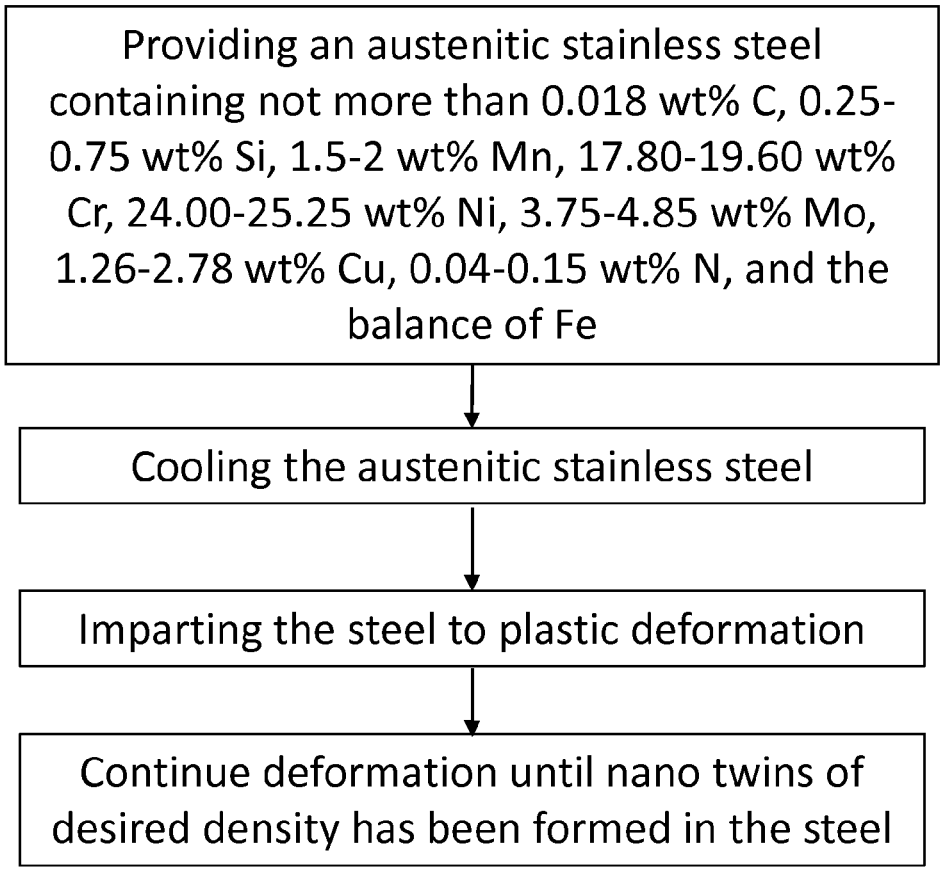

As illustrated in FIG. 1, the inventive method involves a pair of decisive parameters, e.g. the temperature and the degree of deformation at that temperature. Firstly the austenitic stainless steel of the inventive composition should be brought to a low temperature, e.g. below 0° C., and subsequently a plastic deformation should be imparted to the steel at that temperature. The plastic deformation is imparted to such a degree that nano twins are formed in the material.

Figure 2A:
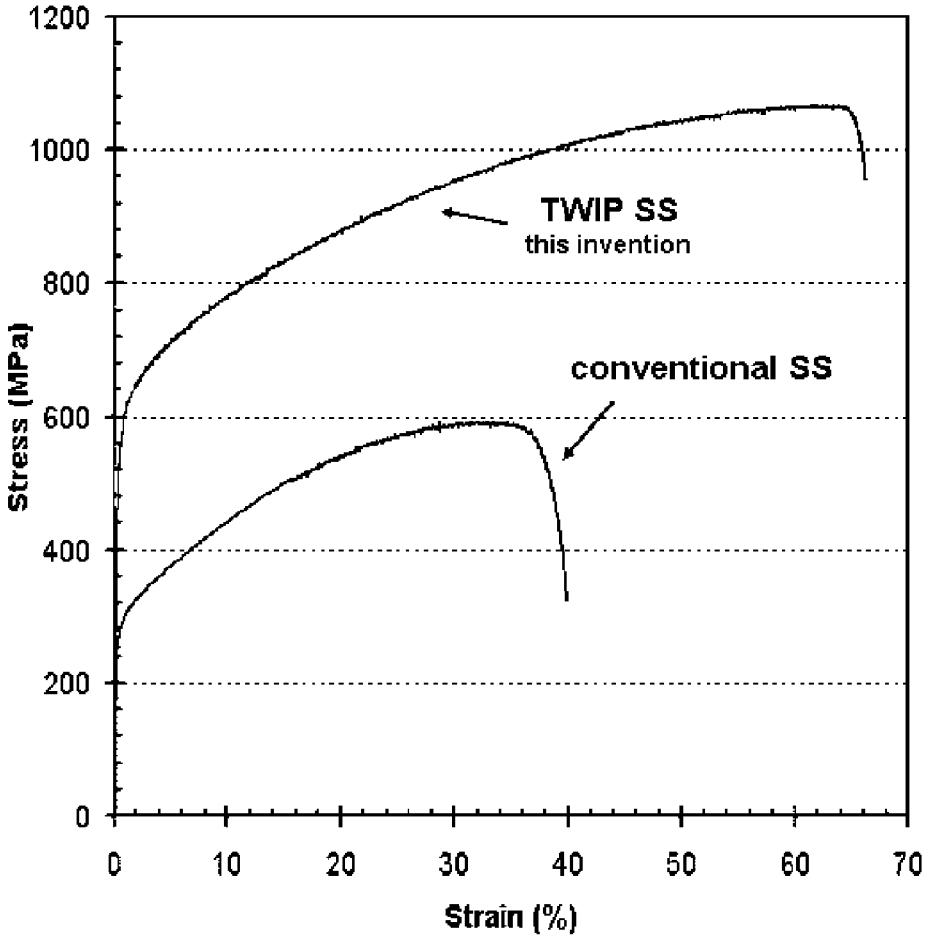

In FIG. 2*a*, a comparison is shown of the stress versus strain curves at −196° C. between the austenitic stainless steel having a composition as defined by the invention and a conventional austenitic stainless steel. As may be observed the induced nano twins change the deformation behaviour and properties of the material to a great extent. The austenitic stainless steel according to the invention shows both a higher strength and a higher ductility due to the continuous formation of nano twins. For the shown example the ductility or elongation was about 65% compared to about 40% for the conventional austenitic steel. This is called twin induced plasticity, TWIP.

For construction materials a high product of ultimate tensile strength and total elongation is desired. From FIG. 2*a* it is apparent that the austenitic steel according to the invention has an ultimate tensile strength of 1065 MPa and a total elongation of about 65% at −196° C., which gives a product of about 69 000. Hence, 1065*65=69225. For other test samples within the inventive composition range the product was as high as 1075*75.5=81162, which is higher than any other available steel.

Figure 2B:
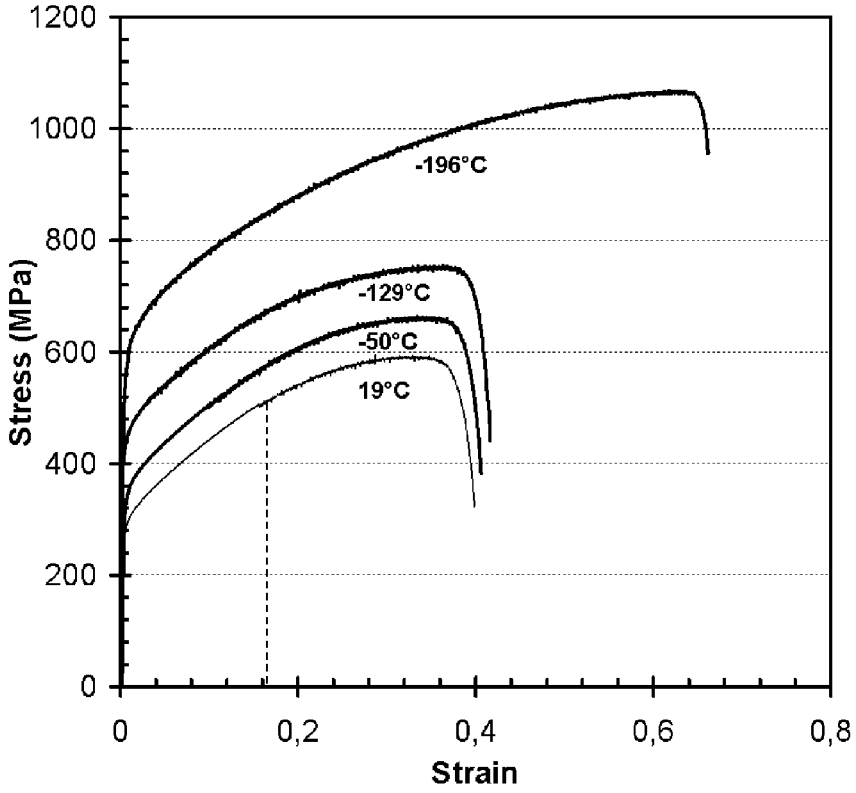
Figure 2C:
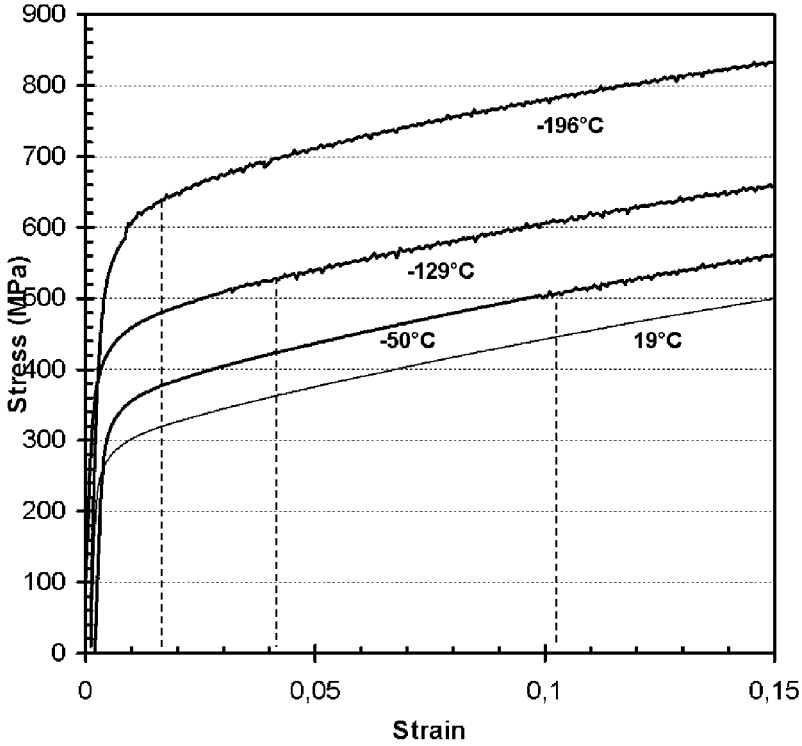

In FIGS. 2*b* and 2*c*, stress versus strain is shown for 4 samples at four different temperatures, wherein FIG. 2*c* is a close up of the low strain range of FIG. 2*b*. From these curves it is firstly apparent that nano twins are induced at all 4 tested temperatures. This is indicated by the scattering of the curves. The scattering indicates that nano twins are formed in the material. Hence, from FIGS. 2*b* and 2*c* it may be determined at what strain nano twins are first induced at a specific temperature.

The vertical lines in FIGS. 2*b* and 2*c* indicate the first appearance of nano twins for the respective temperature curve. The scattering of the curves is not clearly apparent in FIGS. 2*b* and 2*c* due to the low preciseness in the reproduction of these curves. FIGS. 2*b* and 2*c* are however based on results from which the nano twin indicating non-linearity is apparent.

Figure 2D:
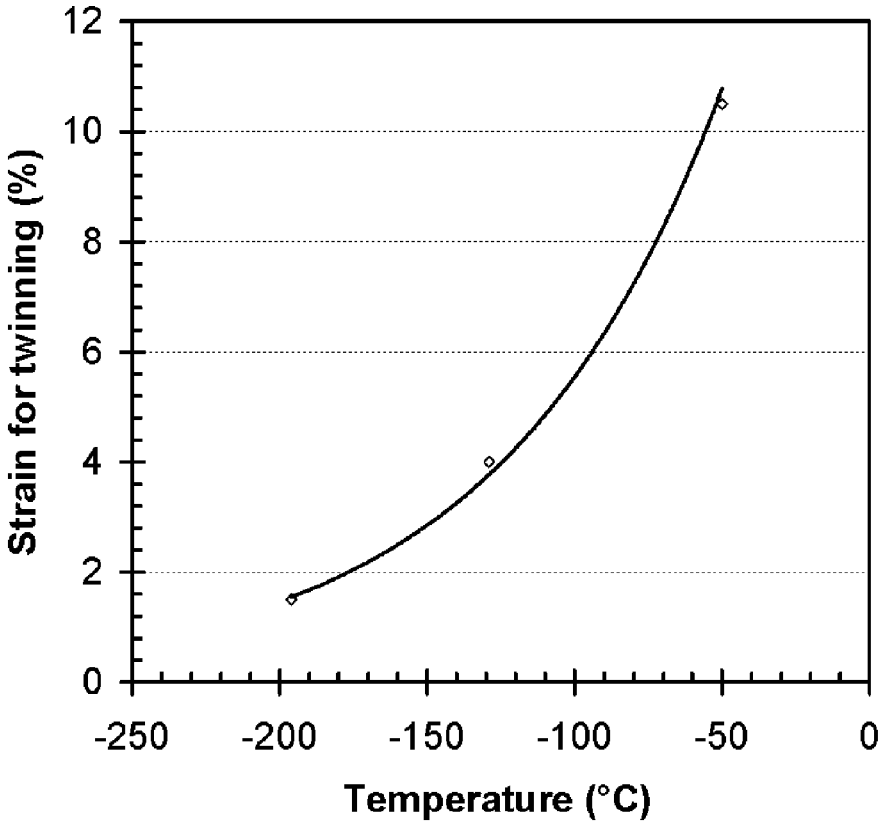

The relation between at what strain nano twins are first induced at a specific temperature is shown in FIG. 2*d*. Hence, it is apparent that nano twins may be induced at room temperature (19° C.), but that the lower the temperature is during the straining, the lower the strain when they are first induced will be.

In view of the invention, it is not only important to induce nano twins in the material. It is desired to induce nano twins to such a degree that an increased strength and an increased elongation are achieved. It should be noted that depending on the temperature it is not possible to plastically deform the material to any degree. At −196° C. it is possible to plastically deform the inventive stainless steel to a total strain of above 60%. At the lower temperatures it is only possible to plastically deform the inventive stainless steel to a total strain between about 35% at 19° C. and about 45% at −129° C.

It is of course also interesting what effect may be achieved by the less marked nano twinning achieved at lower temperatures. In table 4 and 5 below the tensile properties of some typical samples of the inventive composition are shown in dependence of the pre-deformation at −196° C. and −75° C., respectively.

From tables 4 and 5 it may be specifically noted that a relatively good effect on both the yield strength at a plastic deformation of 0.2% and the tensile strength is achieved at a total straining of about 35%.

TABLE 4

Tensile properties achieved after pre-deformation at −196° C.

| pre-deformation % | RP0.2 Mpa | Rm Mpa | A % |
|---|---|---|---|
| 17 | 771 | 876 | 27.2 |
| 50 | 921 | 1047 | 18.1 |
| 65 | 1091 | 1224 | 14.1 |

TABLE 5

Tensile properties achieved after pre-deformation at −75° C.

| pre-deformation % | RP0.2 MPa | Rm MPa | A % |
|---|---|---|---|
| 15 | 565 | 687 | 32.5 |
| 35 | 834 | 860 | 19.2 |

As may be expected an increase of the formation of nano twins could be observed if the material is brought to a lower temperature before the plastic deformation is imparted to the material. The effect increased with a further lowering of the temperature to −50° C., −100° C. and down to −196° C., before the plastic deformation is imparted to the material.

It is however worth noting in table 5 that a relevant increase of both the yield strength at a plastic deformation of 0.2% (834 MPa) and the tensile strength (860 MPa) is achieved at total strain deformation of 35% at −75° C. From the diagrams shown in FIGS. 2*b* and 2*c* it has been shown that nano twins are formed in the austenitic steel according to the inventive composition at a temperature as high as 19° C. This indicates that it is possible to induce nano twins that increase the mechanical properties of the steel at that temperature.

From the results presented above it may be interpolated that nano twins may be induced in the steel to a degree that increases both the yield strength at a plastic deformation of 0.2% and the tensile strength by means of a total strain deformation of at least 35% at a temperature of −75° C. or below. Further, it may be extrapolated the a reasonable increase of said tensile properties may be achieved at a temperature of about 0° C. by a total strain deformation of at least 35%.

To summarise it may be concluded that in order to obtain an important effect the material needs to be plastically deformed to an extent that corresponds to a plastic deformation of at least 30%. An effect may be observed already at 10%, but it is more important and better distributed throughout the material at a higher degree of plastic deformation. Further, the temperature and the degree of plastic deformation cooperates in such a way that a lower deformation temperature provides a greater effect of induced nano twins at a lower deformation level. Hence, the needed deformation level depends on the temperature at which the deformation is performed.

In the examples it has proven possible to induce nano twins by various types of plastic deformation, e.g. both by tension and compression. A preferred and controllable type of straining is drawing. When the material is processed by drawing it is very easy to control the magnitude of the plastic deformation.

It is however also possible to produce nano twins by means of a plastic deformation imparted to the material by compression, e.g. by rolling.

On the other hand, generally, the effect of the formation of nano twins increases with an increase of the level of the plastic deformation.

The formation of nano twins is also faintly dependent at which rate the deformation is imparted to the material. Especially, the rate should not be too high in order to avoid the rapid temperature increase in the material. If the rate is too low, on the other hand, the problem is rather that the process is unnecessarily unproductive.

Therefore, deformation rate should preferably be greater than 0.15% per second (4.5 mm/min), preferably more than 0.35% per second (10.5 mm/min). Further the deformation should be imparted to the material at a rate of less than 3.5% per second, preferably less than 1.5% per second. Also, the deformation should preferably not be imparted to the material in one deformation only. Instead, the plastic deformation may advantageously be imparted to the material intermittently with less than 10% per deformation, preferably less than 6% per deformation, and more preferably less than 4% per deformation. As indicated above intermittent deformation implies that the stress is momentarily lowered, to e.g. about 80%, for a short period of time, e.g. a few seconds, before the drawing is resumed for the next step.

Therefore, as indicated above under "Examples", a plastic deformation of at least 40%, or preferably at least 50% may be imparted to the material at the low temperature. Generally, the plastic deformation should be held between 35% and 65% in order to achieve an important formation of nano twins. Below 35% the effect is still apparent but may not be as important as desired. Above 75% the material may rupture.

The yield strength of the nano twinned austenitic stainless steel is 1090 MPa, which is almost four times higher than that of a conventional austenitic stainless steel. The ultimate tensile strength is about 1224 MPa for the austenitic steel according to the invention shown in the example, which is more than twice as much as that of the conventional austenitic steel.

Figure 3:
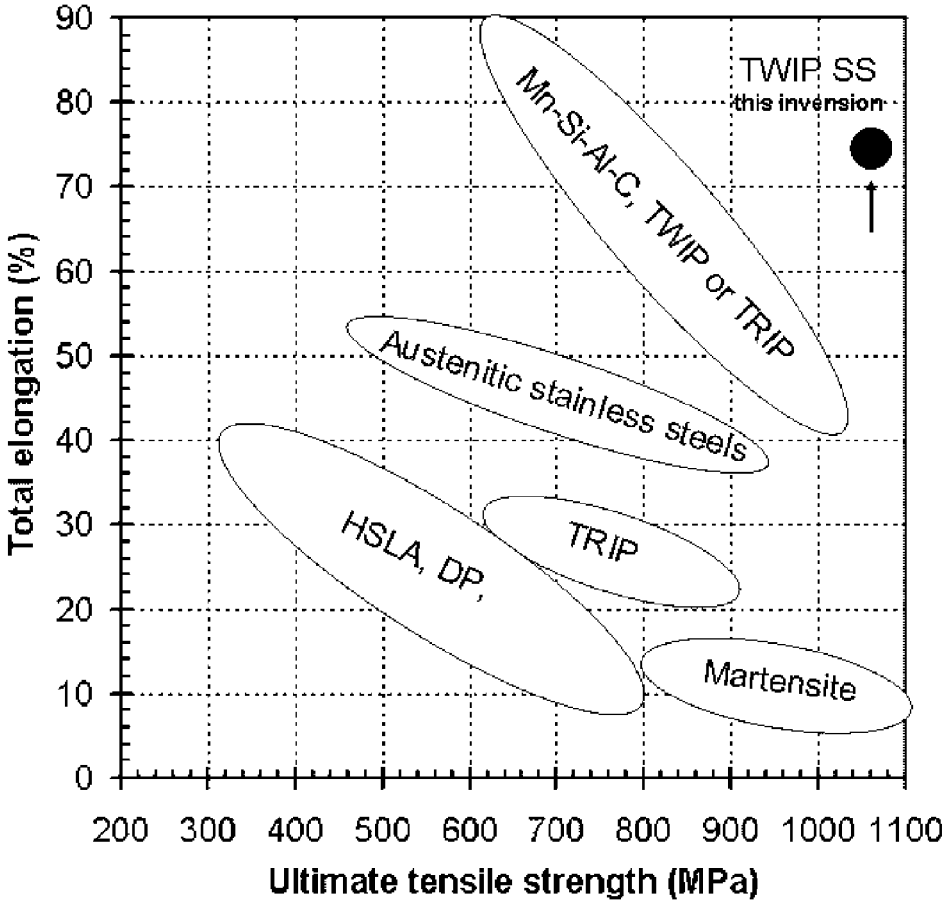
FIG. 3 shows the properties of the inventive twin induced austenitic steel in comparison to the properties of commercially available steels.

This fact is apparent from FIG. 3, where the properties of the inventive twin induced austenitic stainless steel are shown in proportion to the properties of commercially available steels. As is apparent from this diagram, the properties of the inventive austenitic stainless steel are higher than for any other available steel.

Microstructure of the Inventive Austenitic Steels

Figure 4:
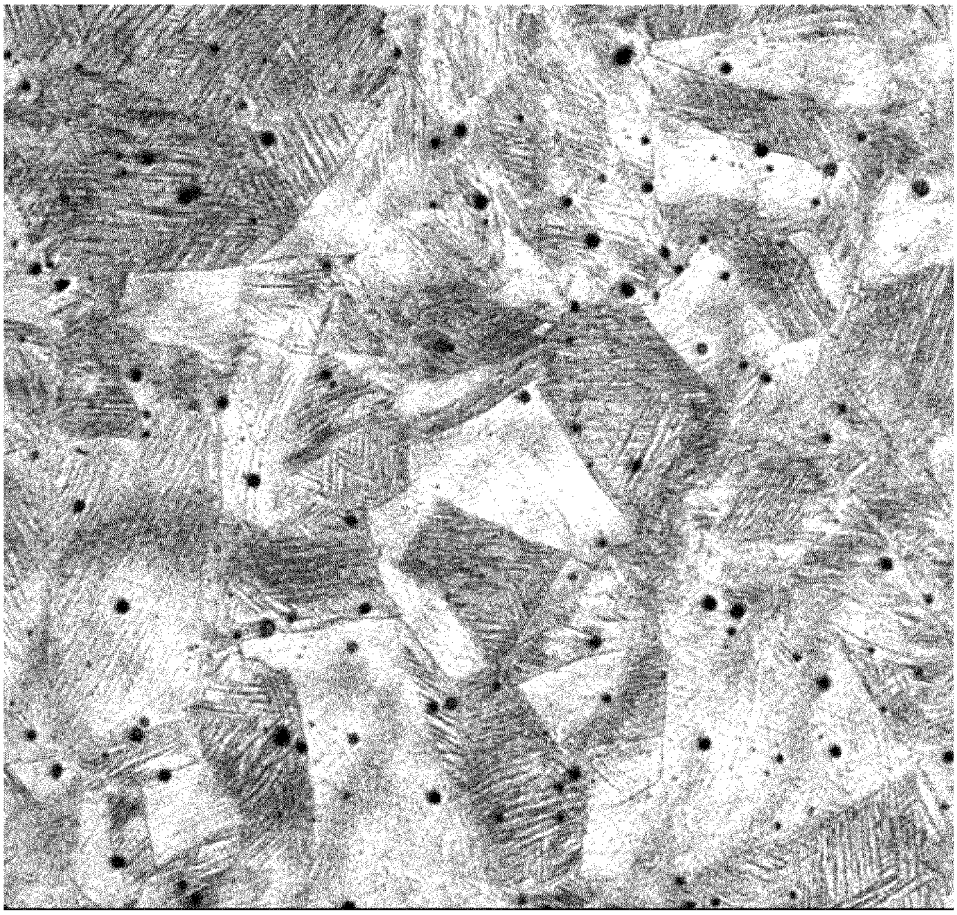
FIG. 4 shows the microstructure of the nano-twinned austenitic stainless steel according to the invention in low magnification.

In FIG. 4, the inventive nano-twinned austenitic stainless steel is shown in low magnification. As is visible, the microstructure is full of needles or lath-shape patterns. These needles or laths have certain crystal orientations, but each cluster has different orientation.

Figure 5:
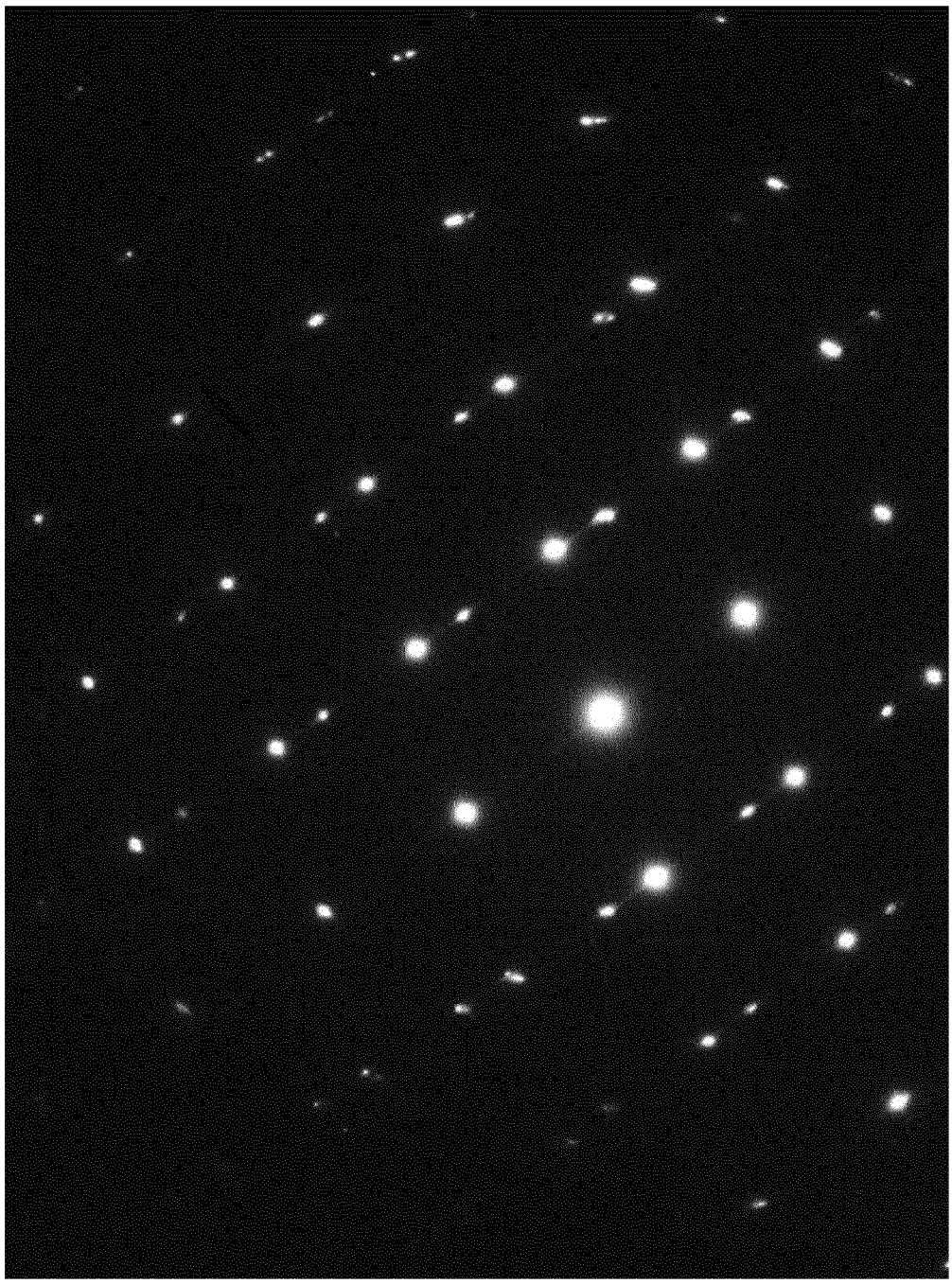
FIG. 5 shows a TEM diffraction pattern of the nano-twinned austenitic stainless steel according to the invention.

The existence of nano twins in the inventive austenitic stainless steels have been confirmed by TEM investigations, e.g. as shown in FIG. 5. From the diffraction pattern shown in FIG. 5 small complementary dots appear close to most dots that constitute the characteristic FCC-structure of the austenitic stainless steel. These complementary dots indicate the presence of twins.

FIGS. 6*a*-6*c* show the inventive material in a TEM investigation, where the twin structure of the inventive material may be seen more clearly. The twin structures are, for most parts, orientated such that they are parallel to each other inside one domain. As will be described below, multi oriented nano twins have however also been observed. The occurrence of multi oriented twins can lead to a very fine grain structure.

Three types of twins may be identified. The first type, which is shown in FIG. 6*a*, involves long parallel twins with uneven distances. The second type, which is shown in FIG. 6*b*, involves small parallel twins with short distances between two twins. The third type, which is shown in FIG. 6*c*, involves multi oriented twins. In this third type of twin formation, the twins are relatively long in one, parallel direction. In other directions, and in between the parallel twins, the twins have a small size and small distances between the twins. All of the nano twins have a so called "nano-scale twin spacing" of up to 500 nm, which indicates that the mean thickness of a twin is less than 500 nm.

It is a fact that the tensile properties of a material increase with a decrease of grain size, or increase of number of twins and reduction of twin space in the material. Therefore, the inventive material may be characterised by the presence of nano twins in the material. One way of quantifying the nano twins is presented by the misorientation mapping of an Electron Back Scatter Diffraction (EBSD).

FIG. 7 shows the results of such a misorientation mapping of an EBSD on the inventive material. In the mapping, bars are presented in pairs. The left bar of each pair corresponds to correlated misorientations and the right bar of each pair corresponds to uncorrelated misorientations. The curve indicates a random theoretical value. Hence, a left hand bar that reaches essentially higher than the corresponding right hand bar indicates the presence of a twin at that specific angle. From the investigation it may be observed that there is a very high peak around the misorientation at about 9°. This indicates that the austenitic steel may have a great amount of special low angle grain boundaries, which may contribute to texture, i.e. grains oriented in a specific orientation. The peak at about 60° indicates Σ3 twins. From the EBSD investigations performed on the inventive materials it have be calculated that they have a microstructure with a density of nano twins that is higher than 37%.

In FIG. 8, a comparison is shown of the stress versus strain curves at room temperature between the austenitic stainless steel according to the invention, i.e. with nano twins, and a conventional cold-worked austenitic stainless steel without nano twins. From this comparison the increase in ductility austenitic steel according to the invention is clearly apparent.

Normally, the ductility of metallic materials decreases with increasing strength. For the nano twinned materials according to the invention, however, it is apparent that the contraction only suffers a relatively moderate decrease at a relatively important increase of strength. This is further illustrated in FIG. 9, where the contraction is shown in correlation to the contraction of some inventive samples. For example, for a specific sample having a yield strength higher than 1100 MPa, the contraction is still higher than 50%.

As may be concluded from the above, the invention presents a relatively broad range of production methods for inducing strengthening nano twins in austenitic stainless steel. The functional composition is however relatively limited, compared to the overall compositional field of austenitic stainless steels. Inside this well defined functional inventive compositional field, useful nano twins may be induced relatively easily by means of the inventive method as defined by the following claims. Hence, a positive effect may be observed throughout the whole inventive scope, although it is stronger in some well defined areas of the invention, e.g. as proposed by the dependent claims.

The invention claimed is:

1. A method of producing a TWIP and nano twinned austenitic stainless steel, comprising the steps of:

providing an austenitic stainless steel that contains not more than 0.018 wt % C, 0.25-0.75 wt % Si, 1.5-2 wt % Mn, 17.80-19.60 wt % Cr, 24.00-25.25 wt % Ni, 3.75-4.85 wt % Mo, 1.26-2.78 wt % Cu, 0.04-0.15 wt % N, and the balance of Fe and unavoidable impurities;

bringing the austenitic stainless steel to a temperature below 0° C.; and imparting plastic deformation to the austenitic steel at that temperature to an extent that corresponds to a plastic deformation of at least 30% such that nano twins are formed in the material.

2. The method according to claim 1, wherein the material is brought to a temperature below −50° C. before the plastic deformation is imparted to the material.

3. The method according to claim 1, wherein the material is brought to a temperature below −75° C. before the plastic deformation is imparted to the material.

4. The method according to claim 1, wherein the plastic deformation is imparted to the material by drawing.

5. The method according to claim 1, wherein the plastic deformation is imparted to the material by compression from rolling.

6. The method according to claim 1, wherein the material is plastically deformed to an extent that corresponds to a plastic deformation of at least 40%.

7. The method according to claim 1, wherein the material is plastically deformed to an extent that corresponds to a plastic deformation of at least 50%.

8. The method according to claim 1, wherein the plastic deformation is imparted to the material intermittently with less than 10% per deformation.

9. The method according to claim 1, wherein the deformation is imparted to the material at a rate of more than 0.15% per second, preferably more than 0.35% per second.

10. The method according to claim 1, wherein the deformation is imparted to the material at a rate of less than 3.5% per second, preferably less than 1.5% per second.

11. An austenitic stainless steel material, comprising a nano twinned austenitic steel that contains not more than 0.018 wt % C, 0.25-0.75 wt % Si, 1.5-2 wt % Mn, 17.80-19.60 wt % Cr, 24.00-25.25 wt % Ni, 3.75-4.85 wt % Mo, 1.26-2.78 wt % Cu, 0.04-0.15 wt % N, and the balance of Fe and unavoidable impurities, wherein a mean nano-scale spacing in the material is below 1000 nm and the nano twin density is above 35%.

12. The austenitic stainless steel material according to claim 11, wherein the mean nano-scale spacing in the material is below 500 nm.

13. The austenitic stainless steel material according to claim 11, wherein the mean nano-scale spacing in the material is below 300 nm.

14. The method according to claim 8 wherein the plastic deformation is imparted to the material intermittently with less than 6% per deformation.

15. The method according to claim 8 wherein the plastic deformation is imparted to the material intermittently with less than 4% per deformation.

* * * * *